United States Patent [19]

Budzich

[11] 4,139,986

[45] * Feb. 20, 1979

[54] LOAD RESPONSIVE VALVE ASSEMBLIES

[76] Inventor: Tadeusz Budzich, 80 Murwood Dr., Moreland Hills, Ohio 44022

[ * ] Notice: The portion of the term of this patent subsequent to Oct. 12, 1993, has been disclaimed.

[21] Appl. No.: 828,325

[22] Filed: Aug. 29, 1977

Related U.S. Application Data

[63] Continuation-in-part of Ser. No. 655,561, May 2, 1976, Pat. No. 4,099,379, Ser. No. 709,205, Jul. 27, 1976, and Ser. No. 800,934, May 26, 1977, Pat. No. 4,082,111.

[51] Int. Cl.[2] ..... F15B 13/08

[52] U.S. Cl. ..... 60/427; 60/445; 91/421; 91/436; 91/446; 137/596.1; 137/596.13

[58] Field of Search ..... 137/596.13, 596.1; 91/421, 436, 446; 60/445, 427

[56] References Cited

U.S. PATENT DOCUMENTS

| | | | |
|---|---|---|---|
| 3,984,979 | 10/1976 | Budzich | 91/446 X |
| 4,058,140 | 11/1977 | Budzich | 91/446 X |

*Primary Examiner*—Gerald A. Michalsky

[57] ABSTRACT

A load responsive fluid power multiple load control system using a first type of load responsive direction control valves responding to upstream pressure differential between inlet and load chambers together with a second type of load responsive direction control valves responding to down stream actuator pressure or pressure differential. Load pressure signals are phased by check valve logic system to the output flow control of fixed or variable displacement pump which maintains a constant pressure differential between pump discharge pressure and highest of the load pressures.

12 Claims, 2 Drawing Figures

LOAD RESPONSIVE VALVE ASSEMBLIES

This is a continuation in part of application Ser. No. 655,561 filed May 2, 1976 for "Load Responsive Fluid Control System", now U.S. Pat. No. 4,099,379, application Ser. No. 709,205 filed July 27, 1976 for "Load Responsive Valve Assemblies" and application Ser. No. 800,934 filed May 26, 1977 for "Load Responsive Fluid Control Valves", now U.S. Pat. No. 4,082,111.

BACKGROUND OF THE INVENTION

This invention relates generally to load responsive fluid control valves and to fluid power systems incorporating such valves, which systems are supplied by a single fixed or variable displacement pump. Such load responsive control valves can be used in a multiple load system, in which a plurality of loads are simultaneously controlled under positive and negative load conditions by separate control valves.

In more particular aspects this invention relates to a fluid power system in which load responsive direction control valves responding to upstream pressure differential between inlet and load chambers are employed together with load responsive valves responding to down stream actuator pressure or pressure differential, both types of load responsive valves transmitting positive load pressure signals to the pump control.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. Such a system, although useful in many applications, is limited by several basic system disadvantages.

Normally the load responsive valve control can maintain a constant pressure differential and therefore constant flow characteristics when operating only one load at a time. With two or more loads, simultaneously controlled, only the highest of the loads will retain the flow control characteristics, the speed of actuation of lower loads varying with the change in magnitude of the highest load. This drawback can be overcome in part by the provision of a proportional valve as disclosed in my U.S. Pat. No. 3,470,694 dated Oct. 7, 1969 and also in U.S. Pat. No. 3,455,210 issued to Allen on July 15, 1969. However, while those valves are effective in controlling positive loads they do not retain flow control characteristics when controlling negative loads, which instead of taking supply the energy to the fluid system and hence the speed of actuation of such a load in a negative load system will vary with the magnitude of the negative load. Especially with socalled overcenter loads, where a positive load may become a negative load, such a valve will lose its speed control characteristics in the negative mode.

This drawback can be overcome by the provision of a load responsive fluid control valve as disclosed in my U.S. Pat. No. 3,744,517 issued July 10, 1973 and my U.S. Pat. No. 3,882,896 issued May 13, 1975. However, while these valves are effective in controlling both positive and negative loads, with pump pressure responding to the highest pressure of a system load being controlled, they still utilize a controlling orifice located between the pump and the motor during positive load mode of operation and therefore control the fluid flow into the fluid motor instead of controlling fluid flow out of the fluid motor.

This drawback can be overcome by provision of load responsive fluid control valves ad disclosed in my U.S. Pat. No. 3,998,134 issued Dec. 21, 1976 entitled "Load Responsive Fluid Control Valves". However, while such valves maintain the pump discharge pressure higher, by a contstant pressure differential, than the highest load pressure of system loads being controlled and are effective in controlling multiple positive loads, while maintaining a relatively constant down stream pressure at the motor exhaust, during control of negative loads those valves supply the motor inlet with throttled down fluid from the pump circuit, therefore using flow from the pump, while controlling a negative load. In certain fluid power control systems it is preferable, while controlling a negative load, to supply fluid to the motor inlet from the motor exhaust circuit instead of using pump capacity.

This drawback can be overcome in part by provision of fluid control valves as disclosed in U.S. Pat. No. 3,807,447 issued to Masuda on Apr. 30, 1974. However, while those valves utilize actuator exhaust fluid for actuator inlet flow requirement when controlling negative loads they regulate actuator inlet pressure by bypassing fluid to a down stream load circuit. Masuda's valves and their proportional control system are based on series type circuit in which excess fluid flow is successively diverted from one valve to the other and in which loads arranged in series determine the system pressure. In such a system flow to the last valve operating a load must be delivered through all of the bypass sections of all of the other system valves, resulting in higher fluid throttling loss. These valves are not adaptable to simultaneous control of multiple loads in parallel circuit operation since they do not provide system load control pressure signal to the pump flow control mechanism.

SUMMARY OF THE INVENTION

It is therefore a principal object of this invention to provide a load responsive fluid control system in which simple load responsive direction control valves can be combined into a valve assembly with more complex load responsive fluid direction and flow control valves which block system pump from motor inlet and supply it with system exhaust flow when controlling negative loads, while both types of valves are transmitting control signals to system pump to maintain the pressure of the system pump higher, by a constant pressure differential, than the highest pressure of the system positive load being controlled.

Briefly the foregoing and other additional objects and advantages of this invention are accomplished by providing a novel load responsive fluid control system for use during simultaneous control of multiple positive and negative loads while using simple and more complex load responsive valves. A system pump is controlled in respect to pressure signal transmitted from system valves, corresponding to the highest system load pressure. Exhaust circuit of the system is pressurized, the exhaust flow being used to provide inlet flow requirements of motors using more complex valves while controlling negative loads.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
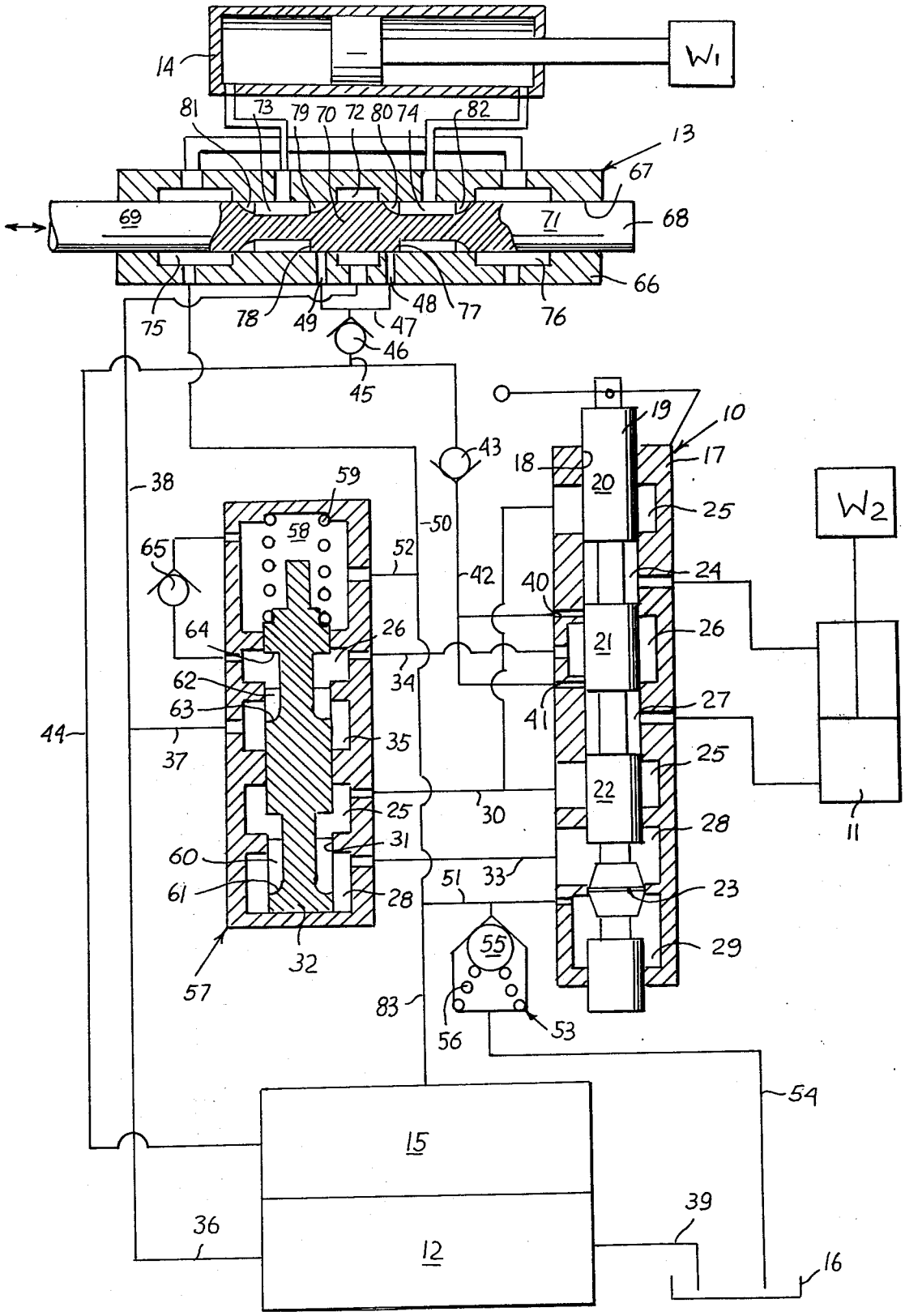
FIG. 1 is a diagramatic sectional view of an embodiment of a flow control valve having a positive load control responsive to actuator upstream pressure differential and a diagramatic sectional view of an embodiment of a flow control valve having positive and negative load control responsive to down stream pressure differential, with lines, throttling valve, system pump, pump control, exhaust relief valve and system reservoir shown diagramatically.

Referring now to FIG. 1, an embodiment of a flow control valve, generally designated as 10, is shown interposed between diagramatically shown fluid motor 11, driving load $W_2$ and a pump 12 of a fixed displacement or variable displacement type driven by a prime mover not shown. Similarly, a flow control valve 13 is interposed between diagramatically shown fluid motor 14 driving a load $W_1$ and the pump 12. Fluid flow from the pump 12 to flow control valves 10 and 13 is regulated by a pump flow control 15. If pump 12 is of a fixed displacement type pump flow control 15 is a differential pressure relief valve, which in a well known manner, by bypassing fluid from the pump 12 to a reservoir 16, maintains discharge pressure of pump 12 at a level, higher by a constant pressure differential, than load pressure developed in fluid motor 11 or 14. If pump 12 is of a variable displacement type pump flow control 15 is a differential pressure compensator, well known in the art, which by changing displacement of pump 12 maintains discharge pressure of pump 12 at a level, higher by a constant pressure differential, than load pressure developed in fluid motor 11 or 14.

The load responsive flow control valve 10 is of a four way type and has a housing 17 provided with a bore 18, axially guiding a valve spool 19. The valve spool 19 is equipped with isolating lands 20, 21 and 22 and a metering land 23. With the valve spool 19 in neutral position as shown in FIG. 1, land 20 isolates a load chamber 24 from an outlet chamber 25, land 21 isolates a supply chamber 26 from load chambers 24 and 27, land 22 isolates the outlet chamber 25 from the load chamber 27 and a first exhaust chamber 28 and metering land 23 isolates the first exhaust chamber 28 from a second exhaust chamber 29. The outlet chamber 25 is cross-connected through line 30, bore 31 guiding a control spool 32 and line 33 to the first exhaust chamber 28. The supply chamber 26 is cross-connected through line 34, bore 31 and the control spool 32 to an inlet chamber 35. The outlet of the pump 12 is connected through discharge lines 36 and 37 to the inlet chamber 35. Similarly, the outlet of pump 12 is connected through discharge line 38 to the load responsive flow control valve 13. Pump 12 is connected by suction line 39 with system reservoir 16. Pressure sensing ports 40 and 41, blocked in neutral position of the valve spool 19 by land 21, are connected through line 42, a check valve 43 and signal line 44 with the pump flow control 15, which can be an integral part of the pump 12 or can be a part of the flow control valve 10. Similarly the pump flow control 15 is connected through lines 44 and 45, a check valve 46 and line 47 with load sensing ports 48 and 49 of the flow control valve 13. Exhaust lines 50, 51 and 52 form an exhaust manifold connecting the combined exhaust flow of flow control valves 10 and 13 with an exhaust relief valve, generally designated as 53, which is connected through line 54 with the system reservoir 16. The exhaust relief valve 53 is provided with a throttling member 55 biased by a spring 56.

A fluid throttling control, generally designated as 57, although shown separately is an integral part of flow control valve 10 and the same numerals are used to denote connecting chambers of fluid throttling control 57 and flow control valve 10. The throttling control 57 has the control spool 32 guided in bore 31. At one end, (the bottom as viewed in FIG. 1) the control spool 32 is subjected to pressure existing in the first exhaust chamber 28. The other end of the control spool 32, communicating with exhaust space 58, is subjected to pressure existing in space 58 and the biasing force of the control spring 59. The control spool 32 is equipped with first throttling slots 60 terminating in throttling edges 61, communicating the outlet chamber 25 with the first exhaust chamber 28, second throttling slots 62 equipped with throttling edges 63, communicating the inlet chamber 35 with the supply chamber 26 and control surface 64 located between the supply chamber 26 and exhaust space 58. Exhaust space 58 is connected with the supply chamber 26, for one way flow, by a suction check valve 65. Increase in pressure differential between the first exhaust chamber 28 and exhaust space 58, acting on the cross-sectional area of the control spool 32, will first balance the preload of the control spring 59 and then move the control spool 32 upward. The location of throttling slots is such that initial movement of the control spool 32 will gradually reduce the passage area between the inlet chamber 35 and the supply chamber 26, throttling the fluid flow between these chambers, until passage between these two chambers closes. Further movement of the control spool 32 upward will connect the supply chamber 26 with exhaust space 58 by control surface 64, while full flow passage is still maintained between the outlet chamber 25 and the first exhaust chamber 28, through first throttling slots 60. Still further upward movement of the control spool 32 will gradually reduce the passage between the outlet chamber 25 and the first exhaust chamber 28, throttling the fluid flow between these chambers, until throttling edges 61 will close the passage between these two chambers. This movement of the control spool 32 upward will also gradually increase the area of communication between the supply chamber 26 and exhaust space 58 through displacement of control surface 64, while still isolating the inlet chamber 35 from the supply chamber 26.

Preferably the size and position of lands of the valve spool 19 are such that movement of the valve spool 19 downward, from the position as shown, will simultaneously connect the load chamber 24 with the pressure sensing port 40 and the load chamber 27 with the outlet chamber 25 and then connect the supply chamber 26 with load chamber 24, while metering land 23 still isolates the first exhaust chamber 28 from the second exhaust chamber 29. Further movement of the valve spool 19 downward through displacement of metering land 23 will gradually open passage between the first exhaust chamber 28 and the second exhaust chamber 29, the area of fluid flow between these two chambers gradually increasing with displacement of valve spool 19. Movement of valve spool 19 upward will first simultaneously connect the load chamber 27 with the pressure sensing port 41 and the load chamber 24 with the outlet chamber 25 and then connect the supply chamber 26 with the load chamber 27. Further upward movement of the valve spool 19 through displacement of metering land 23 will gradually open passage between the first exhaust chamber 28 and the second exhaust chamber 29, the area of flow between these two chambers gradually increasing with displacement of valve spool 19.

The flow control valve 13 is of a four way type and has a housing 66 provided with a bore 67 axially guiding a valve spool 68. The valve spool 68 is equipped with lands 69, 70 and 71, which in neutral position of the valve spool 68, as shown in FIG. 1, isolate a fluid supply chamber 72, load chambers 73 and 74 and outlet chambers 75 and 76. Housing 66 is provided with load sensing ports 49 and 48, located between supply chamber 72 and load chambers 73 and 74, which in neutral position of valve spool 68 are blocked by land 70. Land 70 is provided with end surfaces 77 and 78 and positive load metering slots 79 and 80 circumferentially spaced from load sensing ports 49 and 48. Negative load metering slots 81 and 82 are provided between load chambers 73 and 74 and outlet chambers 75 and 76. A suitable device is provided to prevent relative rotation of valve spool 68 in respect to bore 67. The timing of the lands and slots of valve spool 68 of control valve 13 preferably is such that when displaced in either direction from its neutral position, as shown in FIG. 1, one of the load chambers 73 or 74 is first connected by end surface 77 or 78 of land 70 to the load sensing port 49 or 48, while load chambers 73 and 74 are still isolated from the supply chamber 72 and outlet chambers 75 and 76. Further displacement of the valve spool 68 from its neutral position, connects load chamber 73 or 74 through positive load metering slots 79 or 80 with the fluid supply chamber 72, while simultaneously connecting through negative load metering slots 81 and 82 and load chamber 73 or 74 with outlet chamber 75 or 76.

With pump 12 of fixed displacement type started up the pump flow control 15 will bypass through lines 83 and 51, the exhaust relief valve 53 and line 54 all of pump flow to the system reservoir 16 at minimum pressure level equivalent to preload in the spring 56, while automatically maintaining pressure in discharge line 36 and 37 at a constant pressure, higher by a constant pressure differential, than pressure in signal line 44 or pressure in exhaust line 50. Therefore all of pump flow is diverted by the pump flow control 15 to the low pressure exhaust circuit, as previously described, without being used by flow control valves 10 and 13. Supply chamber 26 of control valve 10 is connected through suction check valve 65 with pressure existing in exhaust space 58 and therefore pressure in the exhaust line 50. The pressure setting of exhaust relief valve 53 is selected to provide the necessary pressure drop through positive load metering slots 79 and 80, to maintain load chamber 73 or 74 at above atmospheric pressure during control of negative load.

With pump 12 of a variable displacement type started up the minimum flow to the system exhaust manifold, composed of exhaust line 50 and exhaust pressure relief valve 53, is supplied by line 83 from the leakage circuit of pump 12, to maintain the system exhaust manifold pressurized. A pressure reducing type regulator can be used, which upon system exhaust manifold pressure dropping below the setting of the exhaust pressure relief valve 35, will throttle some of the pump discharge flow and supply it to the exhaust manifold, to maintain it at a certain minimum pressure level. In a manner as previously described pump flow control 15, acting through the displacement changing mechanism of the pump 12, will automatically maintain pressure in discharge lines 36 and 37 at a constant pressure, higher by a constant pressure differential, than pressure in signal line 44, which with control valves 10 and 13 in their neutral position, equals the pressure of the exhaust manifold.

Assume that valve spool 68 was initially displaced from left to right to a position in which end surface 78 connects load sensing port 49 with load chamber 73, while load chamber 73 is still isolated from supply chamber 72 and load chamber 74 is still isolated from the outlet chamber 76. Assume also that load chamber 73 is subjected to a positive load pressure of load $W_1$. Positive load pressure, transmitted from the load sensing port 49 through line 47, will open check valve 46, close check valve 43 and will be transmitted through signal line 44 to the pump flow control 15. Since the pump flow control 15 automatically maintains a constant pressure differential between discharge line 36 and signal line 44, the discharge pressure of the pump 12 will be automatically increased to the level, higher by a constant pressure differential, than the load pressure existing in load chamber 73. Therefore a constant pressure differential will be automatically maintained by the pump flow control 15 between the supply chamber 72 and the load chamber 73. Further displacement from left to right of valve spool 68 will create an orifice between supply chamber 72 and load chamber 73 through positive load metering slot 79. Since, as previously described, a constant pressure differential is automatically maintained across this orifice, the flow through the orifice will be proportional to the orifice area and independent of the positive load pressure level existing in load chamber 73. Since the area of the orifice, created by displacement of positive load metering slot 79, is proportional to the displacement of the valve spool 68 from its neutral position, each specific position of valve spool 68 will correspond to a constant specific level of the rate of flow from the supply chamber 72 to the load chamber 73, irrespective of the system pressure as dictated by load $W_1$.

Assume that the valve spool 68 was moved from its neutral position from right to left, connecting the load chamber 74 to pressure sensing port 48, while the load chamber 74 is still isolated from the supply chamber 72 and the load chamber 73 is still isolated from the outlet chamber 75. Assume also that the load chamber 73 is subjected to a negative load pressure of load $W_1$, which automatically maintains the load chamber 74 at low pressure level. Therefore low pressure signal, transmitted from the pressure sensing port 48, will be blocked by the check valve 46 and will not affect the setting of the pump flow control 15. Further displacement of the valve spool 68 to the left will create an area of orifice between the load chamber 73 and the outlet chamber 75 through the negative load metering slot 81, while automatically connecting load chamber 74, through the positive load metering slot 80, with supply chamber 72, which is subjected to the minimum discharge pressure level of pump 12. In a well known manner the fluid subjected to negative load pressure will be throttled between the load chamber 73 and the outlet chamber 75, resulting in change in position of load $W_1$, while the replenishing fluid is supplied to fluid motor 14 from the supply chamber 72 through the positive load metering slot 80.

Assume that the valve spool 19 is moved downward, from the position shown in FIG. 1. This will communicate the load chamber 24 with the pressure signal port 40 and the load chamber 27 with the outlet chamber 25, while the metering land 23 still isolates the first exhaust chamber 28 from the second exhaust chamber 29. Assume also that the load chamber 24 is subjected to pressure of positive load. High pressure fluid will be transmitted through the pressure sensing port 40, line 42, and opening the check valve 43 will be further transmitted through line 44 to the pump flow control 15 of variable displacement pump 12. This high pressure fluid conducted through line 45 will also close the check valve 46. In a well known manner the pump flow control 15 will vary the flow delivered from pump 12, to maintain a pressure in discharge line 36, at a level higher by a constant pressure differential than the positive load pressure in the load chamber 24. Since the load chamber 24 is subjected to a positive load the load chamber 27, connected by displacement of the valve spool 19 to the outlet chamber 25, will be subjected to zero pressure.

Assume that the valve spool 19 is further moved downward connecting the supply chamber 26 with the load chamber 24, while metering land 23 still isolates the first exhaust chamber 28 from the second exhaust chamber 29. Increase in the pressure in the load chamber 24 will overcome the resistance of load $W_2$. Since the outlet of the fluid motor 11 is connected through load chamber 27 and the outlet chamber 25 to the first exhaust chamber 28 which is blocked by metering land 23, in a well known manner, pressure in the load chamber 27, the outlet chamber 25, and the first exhaust chamber 28 will begin to rise. This increased pressure in the first exhaust chamber 28 will equal the difference between the pressure in the load chamber 24 (which is connected to supply chamber 26) and the pressure necessary to support the load $W_2$. Increase in pressure in the first exhaust chamber 28, reacting on the cross-sectional area of the spool 32 will reach a force level which will overcome the preload in the control spring 59 and will move the control spool 32 upward, closing the passage between the inlet chamber 35 and the supply chamber 26 and interrupting the supply of high pressure fluid to the supply chamber 26 and the load chamber 24. Subjected to the force of the pressure differential, existing between the first exhaust chamber 28 and exhaust space 58 and the biasing force of the control spring 59 the spool 32 of throttling control valve 57 will modulate to maintain a relatively constant pressure differential between first exhaust chamber 28 and exhaust space 58, by regulating the pressure level in the supply chamber 26 and load chamber 24. This relatively constant controlled pressure differential between first exhaust chamber 28 and exhaust space 58 will be approximately equal to the quotient of the preload in control spring 59 at the control position of spool 32 and the cross-sectional area of spool 32. Any rise in pressure in the first exhaust chamber 28, over that equilvalent to the relatively constant controlled pressure differential level, will move the spool 32 upward into a new modulating position, to relieve some of the pressure in the supply chamber 26, by cross-connecting it through control surface 64 with exhaust space 58, while maintaining passage between the inlet chamber 35 and the supply chamber 26 closed. Conversely, any decrease in the pressure in the first exhaust chamber 28 below that, equivalent to the relatively constant controlled pressure differential level, will move the spool 32 downward, first closing communication between the supply chamber 26 and exhaust space 58 and then gradually connecting the supply chamber 26 with high pressure fluid in the inlet chamber 35. Therefore the throttling control 57 will automatically regulate the pressure in the first exhaust chamber 28 to maintain a relatively constant controlled pressure differential between the first exhaust chamber 28 and exhaust space 58. With pressure in exhaust space 58 remaining constant the throttling control 57 will automatically maintain the pressure in the first exhaust chamber 28 at a level to retain a relatively constant pressure differential between the first exhaust chamber 28 and exhaust space 58, approximately equivalent to the quotient of the biasing force of the control spring 59 and the cross-sectional area of the spool 32.

Further movement downward of valve spool 19 through the displacement of metering land 23, will create an orifice between the first exhaust chamber 28 and the second exhaust chamber 29. Fluid flow will take place through the orifice between these chambers, momentarily lowering pressure in the first exhaust chamber 28. The spool 32 of throttling control 57 will change its modulating position, moving downward, creating an opening between the inlet chamber 35 and the supply chamber 26 through second throttling slots 62, throttling the fluid flow between those chambers, to maintain the pressure differential between the first exhaust chamber 28 and exhaust space 58 at a relatively constant level. Exhaust space 58 is connected through exhaust line 50 with the second exhaust chamber 29. Therefore a relatively constant pressure differential will also be maintained by the throttling control 57 between the first exhaust chamber 28 and the second exhaust chamber 29. Since the flow through the orifice at the metering land 23 is proportional to the orifice area, once a relatively constant pressure differential is maintained across the orifice, and since this pressure differential is automatically maintained relatively constant by the throttling control 57, the flow between the first exhaust chamber 28 and the second exhaust chamber 29 will also be relatively constant for any specific position of valve spool 19 and independent of the load pressure in the load chamber 24. Therefore each specific position of valve spool 19, corresponding to a specific orifice area between first exhaust chamber 28 and second exhaust chamber 29, will also correspond to a specific controlled flow level through the load responsive flow control valve 10. The fluid throttling control 57 maintains a relatively constant pressure differential between first exhaust chamber 28 and second exhaust chamber 29, the flow control therefore being independent of the pressure level in the second exhaust chamber 29. While throttling the fluid flow between the inlet chamber 35 and the supply chamber 26, to maintain a relatively constant pressure differential between first and second exhaust chambers, the spool 32 maintains full flow passage between the outlet chamber 25 and the first exhaust chamber 28, through first throttling slots 60. A sudden increase or decrease in load $W_2$, through corresponding momentary decrease or increase in pressure in the first exhaust chamber 28, will result in the change in throttling position of the spool 32. In each case with the condition of force equilibrium established, the pressure differential between first and second exhaust chambers will return to its relatively constant controlled level, with the spool 32 modulating in each new position.

The exhaust fluid flow from the second exhaust chamber 29 is transmitted through exhaust line 51 to the low pressure exhaust relief valve 53, which permits the exhaust flow to reach the reservoir 16, while maintaining constant minimum pressure level in the second exhaust chamber 29, equivalent to the preload of the spring 56. Since the pressure in the exhaust space 58 is maintained at a constant level by the exhaust relief valve 53, the throttling control 57 throttles flow of fluid through flow control valve 10 to maintain pressure in the first exhaust chamber 28 at a constant level for any specific position of the valve spool 19.

Assume that the valve spool 19 is moved downward from its neutral position as shown in FIG. 1, connecting first the load chamber 27 with the outlet chamber 25 and the load chamber 24 with the pressure sensing port 40, while land 21 still isolates supply chamber 26 from load chamber 24 and metering land 23 isolates the first exhaust chamber 28 from the second exhaust chamber 29. Assume also that load chamber 27 is subjected to pressure of a negative load. Low pressure signal will be transmitted from pressure sensing port 40 to the pump flow control, in a well known manner, bringing the system pump to its minimum standby pressure level. Negative load pressure from the outlet chamber 25 will be transmitted through line 30 and first throttling slots 60 to the first exhaust chamber 28, where it will react on the cross-sectional area of the spool 32 moving it upward all the way, compressing the control spring 59 and engaging control spool stop. In this position the spool 32 will isolate the first exhaust chamber 28 from the outlet chamber 25, isolate the inlet chamber 35 from the supply chamber 26 and connect the supply chamber 26 with exhaust space 58. When, due to leakage across the metering land 23, which can normally be expected, the pressure in the first exhaust chamber 28 drops to a level, equivalent to the biasing force of the compressed control spring 59, the spool 32 will move downward and start to modulate, throttling the fluid flow from the outlet chamber 25 to maintain a relatively constant pressure in the first exhaust chamber 28, the passage between the inlet chamber 35 and the supply chamber 26 remaining blocked and the supply chamber 26 remaining open to exhaust space 58.

Further downward movement of the valve spool 19 will first connect the supply chamber 26 with the load chamber 24, both of which are subjected to low pressure, and then through displacement of metering land 23 will open an orifice between the first exhaust chamber 28 and the second exhaust chamber 29. The resulting flow between these chambers will momentarily lower the pressure in the first exhaust chamber 28, causing an unbalance of forces acting on the spool 32. As a result the spool 32 will move downward throttling fluid flow from outlet chamber 25 to the first exhaust chamber 28, the outlet chamber 25 being subjected to pressure of the negative load, to maintain a relatively constant pressure differential between the first exhaust chamber 28 and exhaust space 58 and therefore also a relatively constant pressure differential between first and second exhaust chambers 28 and 29, while the fluid flow through the orifice between these chambers takes place. The spool 32 will modulate to maintain a relatively constant pressure differential between the first exhaust chamber 28 and the second exhaust chamber 29 in a position, at which first throttling slots 60 are partially closed and control spring 59 further compressed and exerting higher biasing force. The relatively constant controlled pressure differential between the first exhaust chamber 28 and exhaust space 58 is approximately equal to the quotient of the biasing force of the control spring 59 and the cross-sectional area of spool 32. Therefore, when controlling a negative load, spool 32 will maintain a relatively constant control pressure differential at a higher level than the controlled pressure differential when controlling a positive type load. As previously described the position of the valve spool 19 and its metering land 23 which may be of a conical shape as shown or may be equipped with conventional metering slots, will determine the area of the orifice between the exhaust chambers and therefore the controlled flow level through the load responsive flow control valve 10 during control of negative load.

Since as previously described, the pressure in the second exhaust chamber 29 is maintained constant by the exhaust relief valve 53, when controlling a positive load the pressure in the first exhaust chamber 28 will be maintained at a first relatively constant pressure level and when controlling a negative load the pressure in the first exhaust chamber 28 will be maintained at a second relatively constant pressure level, the second relatively constant pressure level being higher than the first relatively constant pressure level due to greater force exerted by the compressed control spring 59.

The displacement of the fluid from the fluid motor 11 requires equivalent fluid flow into the fluid motor 11 to prevent cavitation. When controlling a negative load the spool 32 isolates the inlet chamber 35 from the supply chamber 26 but connects the supply chamber 26 with exhaust space 58. The fluid motor exhaust fluid flows from second exhaust chamber 29 through exhaust lines 51 and 50 into exhaust space 58, from which it can follow two paths on its way to the load chamber 24 and fluid motor 11. The fluid can flow from exhaust space 58 through the area created by displacement of control surface 64 to the supply chamber 26 and load chamber 24. The fluid can also flow from exhaust space 58 through suction check valve 65 to the supply chamber 26 and to the load chamber 24. If the fluid flow from the second exhaust chamber 29 is higher than the flow requirement of load chamber 24, part of this flow will be diverted through low pressure exhaust relief valve 53 and therefore fluid will be supplied to load chamber 24 at a pressure, equivalent to setting of low pressure exhaust relief valve 53.

Figure 2:
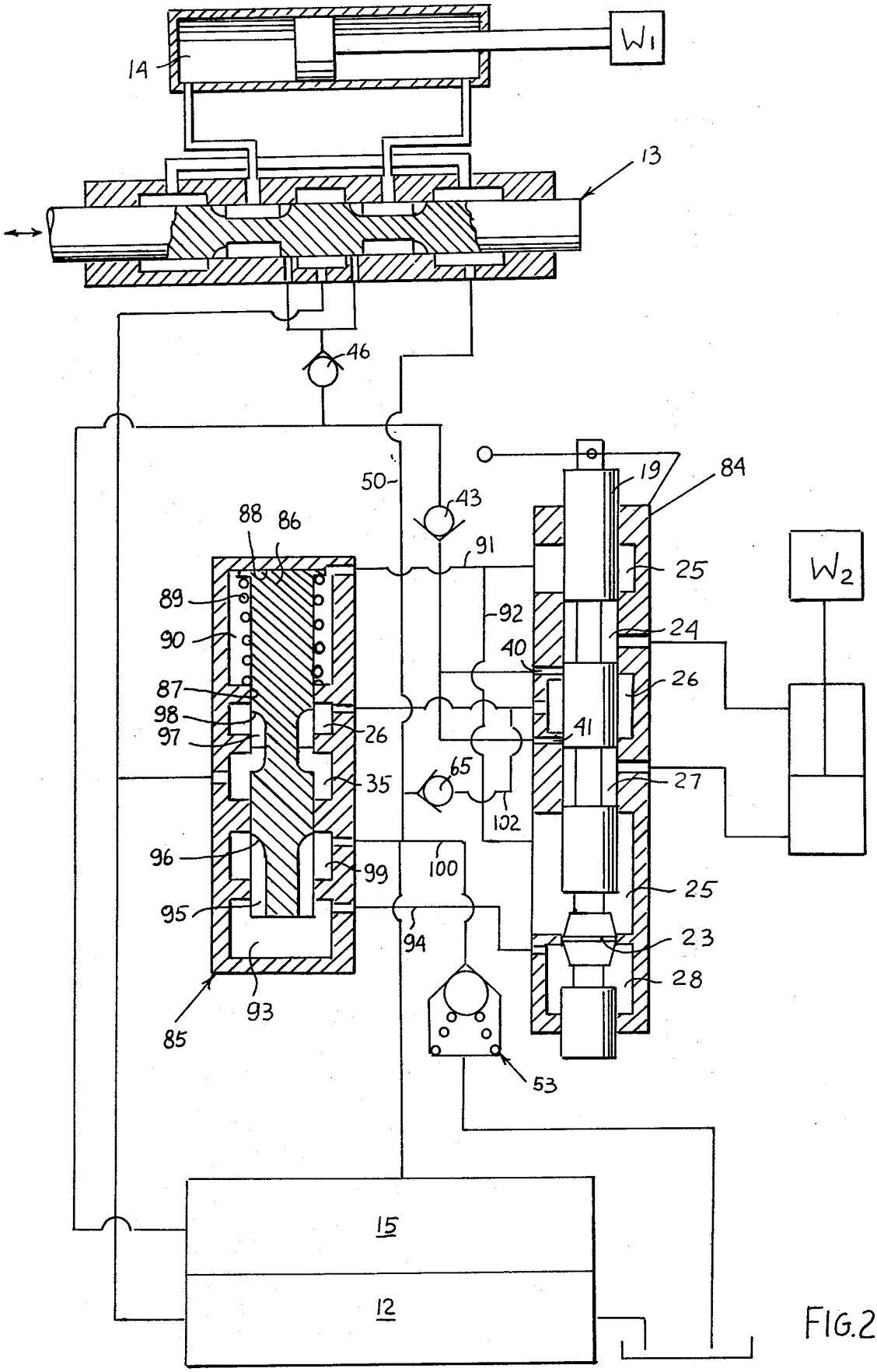
FIG. 2 is a diagramatic representation of system components essentially the same as shown in FIG. 1 with throttling valve responding to down stream pressure differential with lines, system pump and pump control, exhaust relief valve and reservoir shown diagramatically.

Referring now to FIG. 2 the flow control valve 13, interposed between the pump 12 controlled by pump flow control 15 and fluid motor 14, is identical in every respect to the flow control valve 13 of FIG. 1. A flow control valve, generally designated as 84, is very similar to the flow control valve 10 of FIG. 1 with the following exception. The metering land 23 of flow control valve 84 is located between the outlet chamber 25 and first exhaust chamber 28, instead of being located between first exhaust chamber 28 and second exhaust chamber 29, as shown in FIG. 1. A fluid throttling control, generally designated as 85, has a throttling spool 86 guided in bore 87 and biased towards engagement with surface 88 by a control spring 89. One end of the spool 86 projects into space 90, which is connected by lines 91 and 92 to outlet chambers 25 of flow control valve 84. The other end of spool 86 projects into space 93, which is connected by line 94 with the first exhaust chamber 28, located down stream of metering land 23. The spool 86, in a similar way as the spool 32, is provided with first throttling slots 95 terminating in throttling edges 96 and second throttling slots 97 terminating in throttling edges 98. The fluid throttling control 85, although shown separately in FIG. 2, would be an integral part of flow control valve 84, the same numerals being used to denote the connecting chambers of fluid throttling control 85 and flow control valve 84. The fluid throttling control 85 is provided with a second exhaust chamber 99, which is connected through line 100 with the exhaust pressure relief valve 53, which in turn is connected by line 54 to reservoir 16. Line 100 and exhaust line 50 are also connected, for one way fluid flow, by the suction check valve 65 and line 102 with the supply chamber 26.

The fluid throttling control 85, while controlling positive and negative loads, acts in a similar way to fluid throttling control 57 of FIG. 1 with the following exception. The fluid throttling control 57 of FIG. 1 responds to pressure drop across a metering land 23 and maintains this pressure drop constant by maintaining a constant pressure differential between first exhaust chamber 28 and the system exhaust pressure. Since the system exhaust pressure is relatively constant the fluid throttling control 57, by throttling action of first and second throttling slots 60 and 62, maintains the first exhaust chamber 28, upstream of metering land 23, at a relatively constant pressure. This relatively constant pressure is maintained during control of both positive and negative loads.

Conversely the fluid throttling control 85 maintains automatically constant pressure differential, through throttling action of first and second throttling slots 95 and 97 between outlet chamber 25 and first exhaust chamber 28, during control of positive and negative loads, the actual pressure levels in outlet chamber 25 and first exhaust chamber 28 varying with the magnitude of the negative load, but maintaining the pressure differential across the metering land 23 at a relatively constant level. Therefore although different control means are used operating at different pressure levels, the actual pressure differential across the metering land 23 is maintained constant both by fluid throttling control 85 and fluid throttling control 87. Therefore the controls of FIGS. 1 and 2 will maintain the fluid flow proportional to the displacement of valve spool 19 from its neutral position during control of both positive and negative loads. The basic timing of flow control valves 10 and 84 is essentially the same.

Assume that control valves 10 and 13 of FIG. 1 are subjected to positive loads $W_2$ and $W_1$ and are simultaneously actuated, load $W_1$ being greater than load $W_2$. Load pressure signal from pressure sensing ports 49 and 48, transmitted through line 47, will open the check valve 46, close the check valve 43 and will be transmitted through signal line 44 to the pump flow control 15. The pump flow control 15, in a manner as previously described, will maintain a constant pressure differential between the pressure in the supply chamber 72 and a positive load pressure in the load chamber 73 or 74, so that the flow control valve 13 will provide proportional flow control and will retain those characteristics as long as load $W_1$ is greater than load $W_2$. The flow control valve 10, controlling load $W_2$ through throttling action of fluid throttling control 57 will retain, in a manner as previously described, the proportional flow characteristics, the displacement of valve spool 19 being proportional to the rate of flow supplied to the fluid motor 11.

Assume that positive load $W_2$ becomes greater than positive load $W_1$, while both loads are being controlled by flow control valves 10 and 13. Load pressure signal, from pressure sensing ports 40 and 41, will open check valve 43, close check valve 46 and will be transmitted through signal line 44 to the pump flow control 15. In a manner as previously described, the flow control valve 10 will retain its proportional flow control feature. The flow control valve 13 however will no longer be controlling the flow of fluid to fluid motor 14 in a proportional way, since the pressure differential, maintained between supply chamber 72 and load chamber 73 or 74, will no longer be constant and will vary with magnitude of the load $W_2$.

Assume that while fluid motor 14 is controlling a positive load fluid motor 11 is controlling a negative load. In a manner as previously described, the flow control valve 13 will retain its proportional flow control feature when controlling load $W_1$. The fluid throttling control 57 will throttle pressure of the negative load $W_2$, blocking off communication between the pump 12, inlet chamber 35 and supply chamber 26, the inlet flow requirements of fluid motor 11 being supplied by the exhaust circuit from the exhaust flow from fluid motor 14 and the exhaust flow from the fluid motor 11.

In the fluid power and control systems, as shown in FIGS. 1 and 2, a simple flow control valve 13 is integrated with flow control valves 10 and 84 to form a load responsive system, in which system pump responds to highest system load pressure, transmitted through check valve logic system from all the system valves, while the positive and negative system loads are being controlled. The simple flow control valves 13 of the flow control systems respond to upstream pressure differential, when controlling positive load, while flow control valves 10 and 84 respond to down stream pressure or pressure differential in control of positive loads, all types of valves being compatible with each other and capable of transmitting control signals to the flow control of the system pump.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A fluid power and control system supplied with pressure fluid by a pump comprising multiple loads controlled by multiple valve assemblies of a first and second type, said first type valve assemblies comprising a housing having a fluid inlet chamber, a fluid supply chamber, at least one load chamber, first load pressure sensing means operable to transmit a control signal, and fluid exhaust means, first type directional control valve means for selectively interconnecting said fluid load chamber with said first load pressure sensing means said fluid supply chamber and said fluid exhaust means, and inlet variable metering orifice means responsive to movement of said first type direction control valve means and operable to throttle fluid between said supply chamber and said load chamber, said second type valve assemblies comprising a housing having a fluid inlet chamber, a fluid supply chamber, first and second load chambers, second load pressure sensing means operable to transmit a control signal, and fluid exhaust means, second type direction control valve means for selectively interconnecting said fluid load chambers with said second load pressure sensing means said fluid supply chamber and said fluid exhaust means, outlet variable metering orifice means responsive to movement of said second type directional control valve means and operable to throttle fluid flow between said load chambers and said fluid exhaust means, second valve means having fluid isolating means between said fluid inlet chamber and said fluid supply chamber, said second valve means responsive to fluid pressures developed at said outlet variable orifice means, and connecting means to connect said fluid supply chamber with said exhaust means when said fluid isolating means isolates said fluid supply chamber from said fluid inlet chamber, control means operable to vary flow delivered from said pump means to said inlet chambers of said first and second type valve assemblies, control line means interconnecting said first and second load pressure sensing means with said control means, control signal direction phasing means in said control line means, said control means responsive to highest pressure in any of said load chambers of said first and second type valve assemblies operating loads and operable to vary fluid delivered from said pump means to said fluid power and control system to maintain a constant pressure differential between pressure in said inlet chambers and said maximum pressure in said load chamber.

2. A fluid power and control system as set forth in claim 1 wherein said second valve means has first fluid throttling means between said fluid inlet chamber and said fluid supply chamber.

3. A fluid power and control system as set forth in claim 1 wherein said second valve means has second fluid throttling means between said fluid load chambers and said fluid exhaust means.

4. A fluid power and control system as set forth in claim 1 wherein said control means has pump displacement changing means to vary fluid flow delivered from said pump to said inlet chambers of said first and second type valve assemblies.

5. A fluid power and control system as set forth in claim 1 wherein said control means has bypass means to vary fluid flow delivered from said pump to said inlet chambers of said first and second type valve assemblies.

6. A fluid power and control system as set forth in claim 1 wherein said control signal direction phasing means contain check valve logic means.

7. A fluid power and control system as set forth in claim 1 wherein said second valve means has force generating means responsive to pressure upstream of said outlet variable orifice means.

8. A fluid power and control system as set forth in claim 1 wherein said second valve means has force generating means responsive to pressure differential acting across said outlet variable orifice means.

9. A fluid power and control system as set forth in claim 1 wherein said exhaust means of said first and second valve assemblies are combined to form an exhaust manifold means.

10. A fluid power and control system as set forth in claim 9 wherein exhaust pressure relief valve means is positioned in said exhaust manifold means.

11. A fluid power and control system supplied with pressure fluid by a pump comprising multiple loads controlled by multiple valve assemblies of a first and second type, said first type valve assemblies comprising a housing having a fluid inlet chamber, a fluid supply chamber, at least one load chamber, first load pressure sensing means operable to transmit a control signal, and fluid exhaust means, first type directional control valve means for selectively interconnecting said fluid load chamber with said first load pressure sensing means said fluid supply chamber and said fluid exhaust means, and inlet variable metering orifice means responsive to movement of said first type direction control valve means and operable to throttle fluid between said supply chamber and said load chamber, said second type valve assemblies comprising a housing having a fluid inlet chamber, a fluid supply chamber, first and second load chambers, second load pressure sensing means operable to transmit a control signal, and fluid exhaust means, second type direction control valve means for selectively interconnecting said fluid load chambers with said second load pressure sensing means said fluid supply chamber and said fluid exhaust means, negative load pressure sensing means to sense negative load pressure in load chamber connected to said exhaust means by said second type direction control valve means, second valve means having fluid isolating means between said fluid inlet chamber and said fluid supply chamber, said second valve means responsive to pressure in said negative load pressure sensing means, and connecting means to connect said fluid supply chamber with said exhaust means when said fluid isolating means isolates said fluid supply chamber from said fluid inlet chamber, control means operable to vary flow delivered from said pump means to said inlet chambers of said first and second type valve assemblies, control line means interconnecting said first and second load pressure sensing means with said control means, control signal direction phasing means in said control line means, said control means responsive to highest pressure in any of said load chambers of said first and second type valve assemblies operating loads and operable to vary fluid delivered from said pump means to said fluid power and control system to maintain a constant pressure differential between pressure in said inlet chambers and said maximum pressure in said load chamber.

12. A fluid power and control system as set forth in claim 11 wherein an outlet variable metering orifice means responsive to movement of said second type direction control valve means is operable to throttle fluid flow between said load chambers and said fluid exhaust means, said second valve means having means responsive to pressure differential across said variable metering orifice means.

* * * * *